United States Patent [19]

Oland

[11] 4,077,599

[45] Mar. 7, 1978

[54] DEVICE FOR FORMING APERTURES IN CONCRETE

[76] Inventor: John H. Oland, 6939 Farrell Rd. SE., Calgary, Alberta, Canada, T2H 0T3

[21] Appl. No.: 711,881

[22] Filed: Aug. 5, 1976

Related U.S. Application Data

[63] Continuation of Ser. No. 550,720, Feb. 18, 1975, abandoned.

[51] Int. Cl.[2] ..... B28B 7/28

[52] U.S. Cl. ..... 249/177; 249/186; 249/205; 249/210

[58] Field of Search ..... 249/124, 63, 146, 175, 249/177, 183, 186, 205, 210; 52/699, 701; 403/298; 425/468; 220/352

[56] References Cited

U.S. PATENT DOCUMENTS

| | | | |
|---|---|---|---|
| 2,249,824 | 7/1941 | Hall | 249/177 |
| 2,286,564 | 6/1942 | Newell | 249/177 |
| 2,637,462 | 5/1953 | Becker | 220/352 |
| 2,684,518 | 7/1954 | Whitlock | 249/177 |
| 2,694,847 | 11/1954 | Christiansen | 249/115 |
| 3,004,320 | 10/1961 | Beckman | 249/177 |
| 3,265,349 | 8/1966 | Hamrick | 249/177 |
| 3,346,230 | 10/1967 | Tolf, Jr. | 249/177 |
| 3,349,531 | 10/1967 | Watson | 403/298 |
| 3,932,048 | 1/1976 | DuPont | 403/298 |

FOREIGN PATENT DOCUMENTS

| | | | |
|---|---|---|---|
| 680,724 | 2/1964 | Canada | 249/177 |
| 830,915 | 12/1969 | Canada | 249/177 |

*Primary Examiner*—Francis S. Husar
*Assistant Examiner*—John McQuade
*Attorney, Agent, or Firm*—Stevens, Davis, Miller & Mosher

[57] ABSTRACT

An aperture forming device is provided for making openings such as tubular holes in concrete or the like during pouring thereof. The device utilizes a tube holder secured to a concrete form; a disposable tube attached to the holder and a cap member at the other or free end of the tube. Concrete is poured around the tube on the form and, after the concrete has set, the form, tube holder and tube may be pulled out of the concrete leaving the tubular aperture. A plurality of the devices can be combined in a pattern to form openings of various shapes.

13 Claims, 10 Drawing Figures

DEVICE FOR FORMING APERTURES IN CONCRETE

This is a continuation of application Ser. No. 550,720 filed Feb. 18, 1975, now abandoned.

This invention relates to structural concrete forming and in particular to a device for forming apertures in concrete walls, floors, slabs, or ceilings during the pouring thereof.

The use of reinforced concrete in the construction industry has increased substantially especially in high-rise apartment and office buildings and particularly for the floors and walls thereof. Provision must be made prior to pouring for the installation of pipes, electrical conduits and the like in or through the concrete after it has cured and the forms have been removed. Otherwise, holes must be drilled in the cured concrete to provide the necessary passages, adding substantial time, danger and expense to the installation of services. Moreover, drilling cured concrete can be most difficult and dangerous if reinforcing rods, cables, conduits, conductors etc happen to be encountered.

The present invention provides a means for forming the necessary apertures in the structural concrete during the pouring thereof thereby reducing additional service installation charges which are now too prevalent in the industry. In accordance with a broad aspect, the aperture forming device for concrete comprises sleeve form holding means for attachment to a concrete base form member and a sleeve form corresponding in size to the desired aperture. The sleeve form is removably mounted at one end on the holding means the engaging surface of the sleeve form and the holding means being such that a friction fit is obtained. If necessary, a closure cap can be provided on the other end of the sleeve form.

The invention is illustrated, by way of example, in the accompanying drawings wherein.

Figure 1:
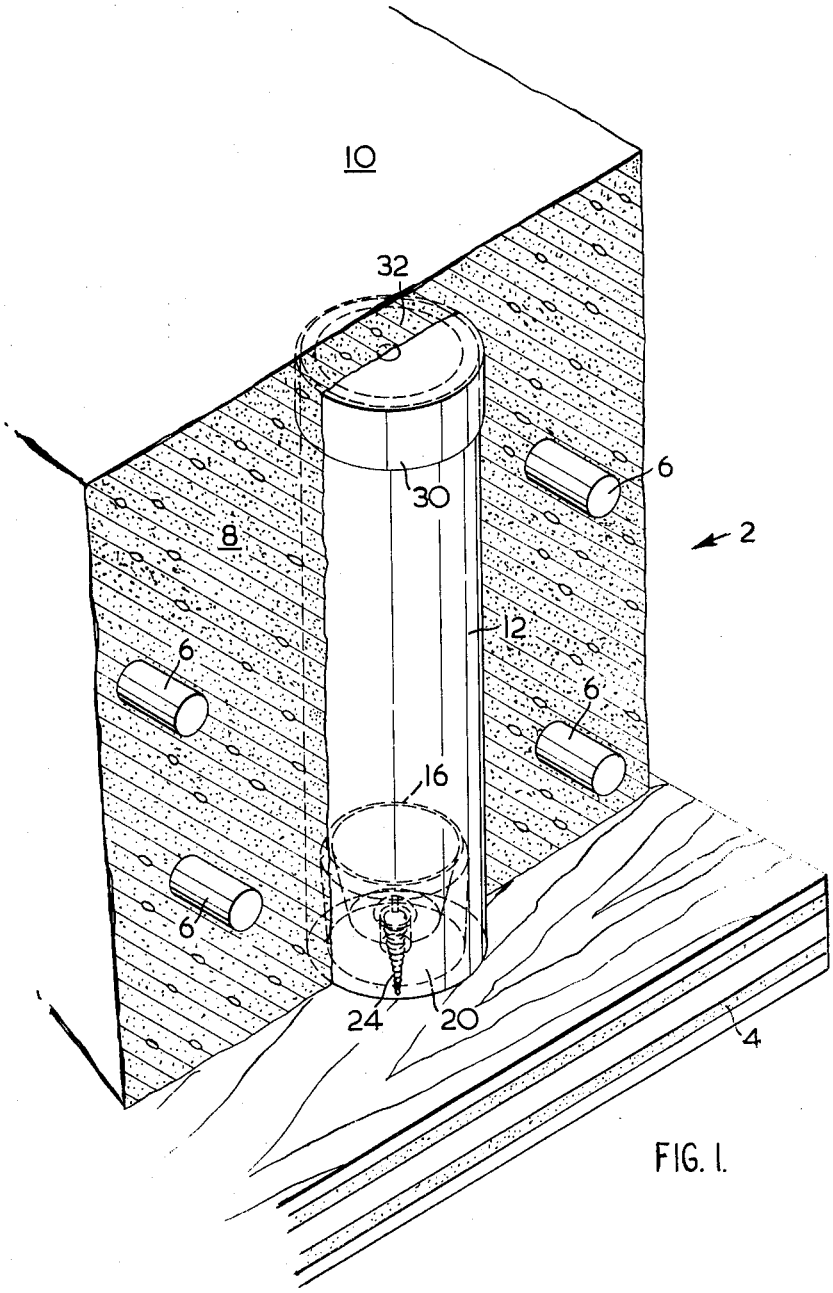
FIG. 1 is a perspective view of one embodiment of the device.

Referring to FIG. 1, the construction of a concrete floor, wall or slab illustrated generally at 2 includes a base form 4, usually plywood, that is braced into position by suitable scaffolding, not shown. If necessary, reinforcing members such as steel rods 6 are laced as desired and suspended over the form 4 and concrete 8 is then poured on the form as shown. In the case of a ceiling-floor structure, the floor 10 is suitably skreeded and troweled to give the desired smooth surface. After curing, the form 4 is removed.

The present invention provides a means for forming apertures in the concrete 8, in this case a floor, for the subsequent passage therethrough of water pipes, heating or cooling conduit, telephone wire and the like. Accordingly, an aperture forming device comprises a form sleeve 12 of any desired diameter or shape such as a tubular form sleeve 12 the length of which may equal the depth of the floor or nearly so. Form sleeve 12 preferably is formed of plastic or heavy waxed or similarly treated fibre material that is both inexpensive to manufacture for purposes of disposal and also strong enough to withstand the ambient pressure of the wet concrete during pouring. As shown in FIG. 1, sleeve 12 is secured to the form 4 (prior to pouring) by means of a cylindrical sleeve form holder 16 shown in FIG. 2.

Figure 2:
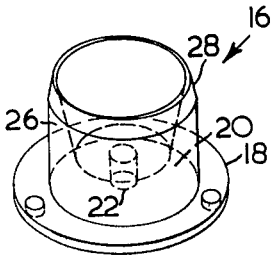
FIG. 2 is a perspective view of the sleeve holder of the device in FIG. 1.

Holder 16 may be provided with a flange 18 on its base 20, the latter having an aperture 22 therein whereby the holder 16 may be removably secured to the form 4 by a screw 24 shown in FIG. 1. The holder 16 of FIG. 2 has a cylindrical body 26 with a tapered upper rim 28 as shown in FIG. 2. The height of the holder 16 should be sufficiently great in relation to that of the sleeve 12 to provide vertical stability to the latter when wet concrete is poured on the form 4 and around the sleeve to prevent the weight of the concrete from shifting the sleeve 12 off the holder. Moreover, the diameter of the outer surface of the holder body 26 and the inner diameter of the sleeve 12 is such that a good frictional fit is obtained between the two elements so that the sleeve 12 will not be floated off the holder 16 by the action and movement of the concrete during pouring.

In numerous instances, an aperture in the floor 10 will not be required immediately and in such cases, the length of the sleeve form will be somewhat less than the thickness of the floor 10, a closure cap 30 being provided on the upper end of the sleeve form.

After the concrete 8 has cured, the form 4 can be pulled away from the concrete 8 taking the holder 16 out of one end of the tube 12 at the same time. As the tube 12 is disposable, it can be left in the aperture. It will also be appreciated that with a plurality of sleeve forms being provided in the construction of a floor, there will be sufficient frictional engagement between several sleeve forms and their holders that the base form 4 will stay in place when its' support (not shown) are removed.

According to FIG. 1, the floor 10 is deeper than the height of the tube 12 thereby leaving a thin cap 32 (say ½ inch) over the now formed aperture. The latter may be located on the floor 10 by plan and measurement or a metal detection device can be used to locate the closure cap 30. The concrete cap 32 can then be fractured by a punch or similar instrument.

Figure 3:
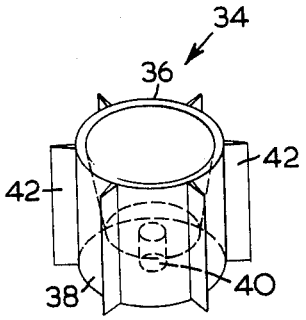
FIG. 3 is a perspective view of a further form of sleeve holder.

A second embodiment of the holder is shown in FIG. 3. A holder 34 comprises a cylindrical body 36 having a base 38 and a central aperture 40 therein for passage therethrough of a screw to secure the holder 34 to a concrete base form. The diameter of the cylindrical body 36 may be substantially less than the inner diameter of the sleeve form to be placed on the holder 34, but the required frictional engagement therebetween is provided be resilient ribs 42 formed on and extending radially from the cylindrical body 36 as shown.

Figure 7:
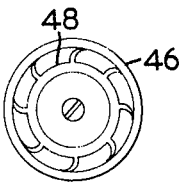
FIG. 7 is a cross section taken along the line 7—7 of FIG. 4.

It will be appreciated that the ribs 42 extend beyond the surface of the sleeve, but that the resilient ribs 42 will bend inwardly toward the body 36 as the sleeve is twisted onto the holder 34 as shown in FIG. 7.

Figure 4:
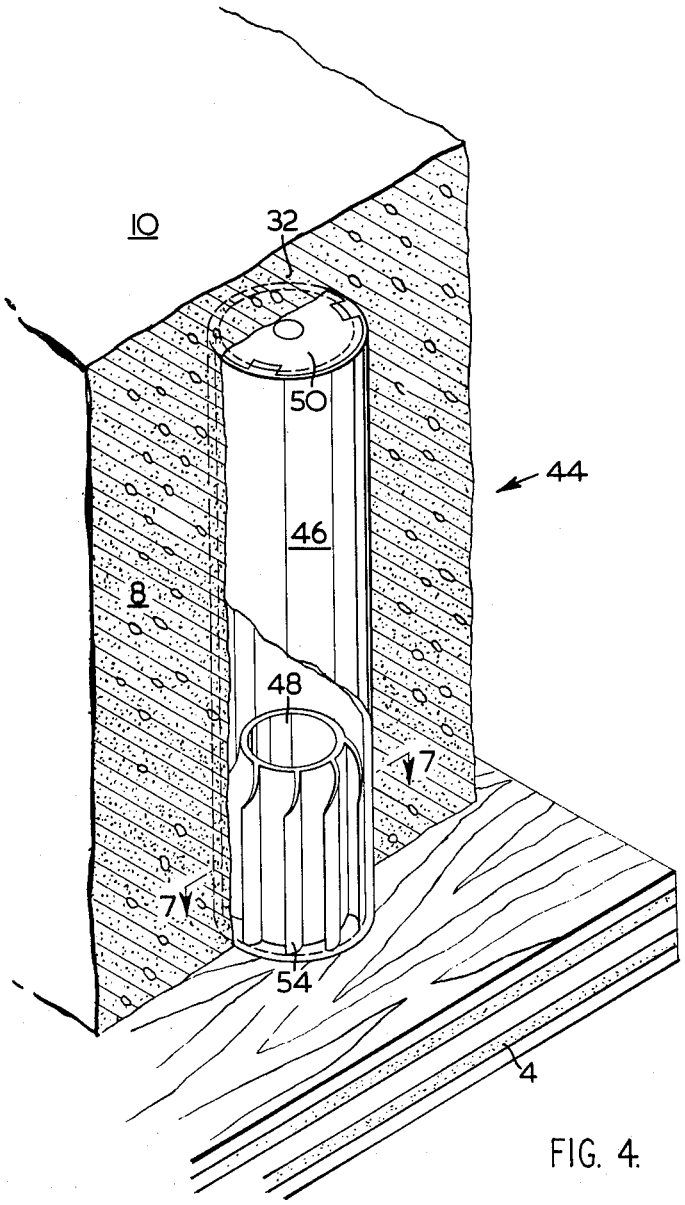
FIG. 4 is a perspective view of a second embodiment of the invention.
Figure 5:
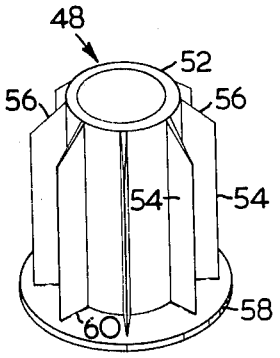
FIG. 5 is a perspective view of the sleeve holder shown in FIG. 4.
Figure 6:
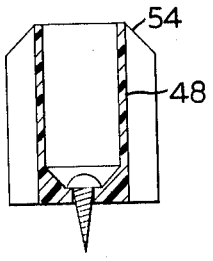
FIG. 6 is a view in cross section of the sleeve holder shown in FIG. 5.

A preferred form of the invention is shown in FIG. 4 which illustrates the aperture forming device 44 in a cured floor 10 of concrete 8, ready for removal. The device 44 includes a sleeve form 46 placed over the frictionally engaging a sleeve form holder 48 that is secured to the concrete base form 4. The upper end of the sleeve 46 is provided with a closure cap 50 preferably formed of metal or a detectable material. According to the FIG. 4 embodiment, the holder 48, shown in detail in FIGS. 3, 5, 6 and 7, has a cylindrical body 52 with a plurality of radially extending ribs 54 formed thereon. The upper ends of the ribs 54 are angularly formed as at 56 to facilitate mounting of the sleeve 46 on the holder 48. The body 52 may be provided with a base flange 58 in which case the lower ends of the ribs 54 may be secured thereto by lines of weakness or fracture lines 60 so that when the sleeve form 46 is pressed downwardly and twisted onto the holder 48, the ribs will let go at their lines of weakness to assume the position of FIG. 7.

Figure 10:
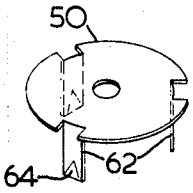
FIG. 10 is a perspective view of the closure cap shown in FIG. 4.

The closure cap 50 is shown is FIG. 10, as being a metal stamping, for example, having depending legs 62 with barbs 64.

It will be apparent from FIG. 4 that after the form 4 is braced in place, the sleeve holder 48 is suitably secured to the form and the sleeve 46 is placed thereover by a downward and twisting motion so that the ribs 54 flex inwardly in engaging the inner surface of the sleeve 46 as indicated in FIG. 4. The closure cap 50 is then placed in the upper end of the sleeve 46, the legs 62 extending inwardly so that their barbs 64 frictionally engage the inner surface of the sleeve 46.

After the concrete 8 is poured around the device 44 and cured, the form 4 is pulled away, drawing with it the sleeve holder 48 in a manner explained in relation to the FIG. 1 embodiment. The remaining concrete cap 32 over the aperture can be easily fractured to complete the aperture when service installation is necessary.

The drawing illustrate the sleeves 12 and 46 being shorter than the floor depth but it will be appreciated that the sleeves can be equal in height to the floor depth if desired.

Figure 8:
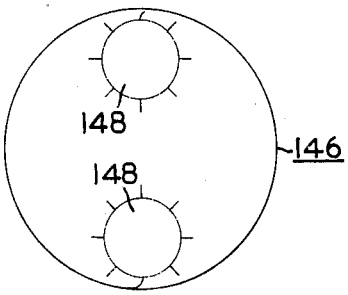
FIGS. 8 and 9 are plan views of aperture forms utilizing the invention.
Figure 9:
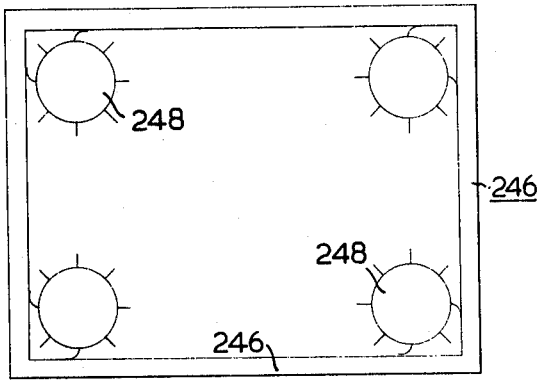

Additionally, although cylindrical sleeves and holders have been described, rectangular and other configurations of aperture forming devices are useful in providing serviceable channels for ductwork and the like and are within the realm of the invention as an example, in FIG. 8, a pair of holders 148 are utilized to retain a large cylindrical sleeve form 146 in place. A further example is shown in FIG. 9 where four holders 248 are used to retain a retangular form 246 in place.

I claim:

1. A device for holding a sleeve form for forming apertures in concrete during the pouring thereof comprising:

a form holder of plastic material adapted for securement to a concrete base form and being adapted to receive said sleeve form against the outer extremities of the holder;

said holder having a body with a tubular outer surface and a base closure portion integrally formed with said body;

an aperture in said base closure portion for passage therethrough of fastening means to secure the holder to the concrete base form;

the end of the body opposite the base closure portion being open for access to insert the fastening means and the interior of the body being tapered up to the periphery of the aperture to facilitate entry of the fastening means and strengthen the body;

a plurality of flexible, longitudinal rib members formed on said body and extending radially outwardly therefrom;

the outer dimension of said body being less than the inside dimension of the sleeve form, with the overall dimension of the holder, including the flexible ribs, being greater than the inside dimension of the sleeve form whereby said rib members will flex in a circumferential direction from engagement with the sleeve form to provide a frictional engagement therewith.

2. The device according to claim 1 wherein the rib members have a length substantially as great as that of the body.

3. The device according to claim 1 wherein the upper terminal ends of the rib members are angulated whereby the upper end of the holder has a frusto-conical configuration.

4. A device for holding a form for forming apertures in a moldable substance during pouring thereof comprising an elongated tubular body having sidewall means, an open end and a closed end, an aperture in said closed end for passage therethrough of fastening means to secure the body to a base form and a taper inside said body extending from the sidewall means to the periphery of the aperture to facilitate entry of fastening means into the aperture and to strengthen the body; a plurality of flexible longitudinal rib members formed on the exterior of said sidewall means and extending outwardly therefrom so that at least one of said devices can be secured on a base form and an aperture form can be positioned adjacent or over the body so that at least some of said rib members will be deflected from their nomrla outward position to frictionally engage the aperture form and hold it in place during pouring of the moldable substance.

5. The device of claim 4 in which the rib members have a length substantially as great as the length of the sidewall means.

6. The device of claim 4 in which the terminal ends of the rib members adjacent the open end are angulated so that the open end portion of the device is of smaller dimension than the closed end portion.

7. The device of claim 4 in which the body is cylindrical.

8. A device for forming an aperture in concrete during pouring thereof comprising in combination:

a. a holder including an elongated cylindrical body of flexible material having a circular sidewall, an open end and a closed end, an aperture in said closed end for passage therethrough of fastening means to secure the body to a concrete base form with a funnel shaped taper inside said body extending from the sidewall to the periphery of the aperture to facilitate entry of fastening means into the aperture and to strengthen the body and a plurality of flexible longitudinal rib members formed on the exterior of said sidewall and extending radially outwardly therefrom; and b. a cylindrical sleeve form of a material to withstand the ambient pressure of wet concrete positioned over the holder, the inner diameter of the sleeve form and the outer diameter of the holder being such that the rib members engage the interior of the sleeve form and are circumferentially flexed so as to frictionally maintain the sleeve form in place when concrete is poured around it.

9. The device of claim 8 in which the rib members have a length substantially as great as the length of the sidewall.

10. The device of claim 8 in which the terminal ends of the rib members adjacent the open end are angulated so that the open end portion of the holder is of smaller dimension than the closed end portion of the holder.

11. The device of claim 8 including an end cap on the sleeve form to prevent entry of concrete into it.

12. The device of claim 11 in which the end cap has as least two depending legs to hold it in place on the sleeve form.

13. The device of claim 12 in which the depending legs have barbs to dig into the sleeve form to hold the end cap in place.

* * * * *